US007976695B2

(12) United States Patent
Brecher

(10) Patent No.: US 7,976,695 B2
(45) Date of Patent: Jul. 12, 2011

(54) HYDROCARBONACEOUS MATERIAL PROCESSING METHODS AND APPARATUS

(75) Inventor: Lee E. Brecher, Laramie, WY (US)

(73) Assignee: University of Wyoming Research Corporation, Laramie, WY (US)

( * ) Notice: Subject to any disclaimer, the term of this patent is extended or adjusted under 35 U.S.C. 154(b) by 728 days.

(21) Appl. No.: 11/792,518

(22) PCT Filed: Dec. 6, 2005

(86) PCT No.: PCT/US2005/044160
§ 371 (c)(1),
(2), (4) Date: Jun. 6, 2007

(87) PCT Pub. No.: WO2007/027190
PCT Pub. Date: Mar. 8, 2007

(65) Prior Publication Data

US 2008/0093259 A1 Apr. 24, 2008

Related U.S. Application Data

(60) Provisional application No. 60/633,856, filed on Dec. 6, 2004, provisional application No. 60/633,744, filed on Dec. 6, 2004.

(51) Int. Cl.
*C10G 57/00* (2006.01)

(52) U.S. Cl. ..... 208/49; 208/50; 208/131; 208/46; 208/67

(58) Field of Classification Search ..... 208/131
See application file for complete search history.

(56) References Cited

U.S. PATENT DOCUMENTS

| | | | | |
|---|---|---|---|---|
| 1,817,926 | A | 8/1931 | McIntire | |
| 2,335,551 | A * | 11/1943 | Trow | 208/51 |
| 2,657,120 | A | 10/1953 | Bigsby et al. | |
| 3,369,992 | A * | 2/1968 | Henke et al. | 208/131 |
| 4,125,437 | A | 11/1978 | Bacon | |
| 4,200,517 | A | 4/1980 | Chalamers et al. | |
| 4,208,251 | A * | 6/1980 | Rasmussen | 208/400 |
| 4,219,405 | A | 8/1980 | Pietzka | |
| 4,233,138 | A * | 11/1980 | Rollmann et al. | 208/106 |
| 4,356,078 | A | 10/1982 | Heavin et al. | |
| 4,504,377 | A * | 3/1985 | Shu et al. | 208/130 |
| 4,822,479 | A | 4/1989 | Fu et al. | |

(Continued)

FOREIGN PATENT DOCUMENTS

CA 2153395 2/1999

(Continued)

OTHER PUBLICATIONS

International Application No. PCT/US05/44160, International Search Report dated Apr. 11, 2008.

(Continued)

*Primary Examiner* — Glenn A Caldarola
*Assistant Examiner* — Michelle L Stein
(74) *Attorney, Agent, or Firm* — Santangelo Law Offices, P.C.

(57) ABSTRACT

Methods and apparatus are disclosed for possibly producing pipeline-ready heavy oil from substantially non-pumpable oil feeds. The methods and apparatus may be designed to produce such pipeline-ready heavy oils in the production field. Such methods and apparatus may involve thermal soaking of liquid hydrocarbonaceous inputs in thermal environments (2) to generate, though chemical reaction, an increased distillate amount as compared with conventional boiling technologies.

33 Claims, 15 Drawing Sheets

U.S. PATENT DOCUMENTS

| | | | | |
|---|---|---|---|---|
| 5,259,945 | A | 11/1993 | Johnson, Jr. et al. | |
| 5,318,697 | A | 6/1994 | Paspek et al. | |
| 5,645,712 | A * | 7/1997 | Roth | 208/131 |
| 5,653,865 | A | 8/1997 | Miyasaki | |
| 5,753,086 | A | 5/1998 | Guffey et al. | |
| 5,755,389 | A | 5/1998 | Miyasaki | |
| 5,836,524 | A | 11/1998 | Wang | |
| 6,972,085 | B1 | 12/2005 | Brecher | |

FOREIGN PATENT DOCUMENTS

| | | |
|---|---|---|
| WO | WO 95/13338 | 5/1995 |
| WO | WO 01/38458 | 5/2001 |
| WO | WO 2007/027190 | 3/2007 |

OTHER PUBLICATIONS

International Application No. PCT/US05/44160, Written Opinion of the International Searching Authority dated Apr. 11, 2008.
Giles, K. A. Fundamentals of Petroleum Refining.
U.S. Appl. No. 60/167,337, "Methods and Apparatus for Heavy Oil Upgrading", filed Nov. 24, 1999.
U.S. Appl. No. 60/167,335, "Methods and Apparatus for Improved Pyrolysis of Hydrocarbon Products", filed Nov. 24, 1999.
U.S. Appl. No. 60/633,856, "Methods and Apparatus for Producing Heavy Oil from Extra-Heavy Feed Oils", filed Dec. 6, 2004.
U.S. Appl. No. 60/633,744, "Distillate Recovery Methods and Apparatus for Oil Processing Applications", filed Dec. 6, 2004.

* cited by examiner

HYDROCARBONACEOUS MATERIAL PROCESSING METHODS AND APPARATUS

CROSS-REFERENCES TO RELATED APPLICATION

This is a United States national phase application of, and claims priority to, international patent application PCT/US2005/044160, filed 6 Dec. 2005, published as WO 2007/027190 A2 on 8 Mar. 2007, said international application claiming priority to each: U.S. Provisional Application 60/633,744, filed 6 Dec. 2004, and entitled "Distillate Recovery Methods and Apparatus for Oil Processing Applications"; and U.S. Provisional Application 60/633,856, filed 6 Dec. 2004, and entitled "Methods and Apparatus for Producing Heavy Oil From Extra-Heavy Feed Oils", each application incorporated herein by reference.

ACKNOWLEDGMENT OF GOVERNMENT SUPPORT

This invention was made with federal government support under Cooperative Agreement No. USDOE contract DE-FC26-98FT40323 awarded by the United States Department of Energy. The federal government may have certain rights in this invention.

TECHNICAL FIELD

Generally, this inventive technology relates to oil processing methods and apparatus. More specifically, specific aspects of the technology relate to the use of thermal environments, perhaps each as part of a stage in a multi-stage processing apparatus and perhaps each adapted to continuously process an oil input (including a hydrocarbonaceous bottoms output by an upstream stage). Such oil input may be heated for a residence time and at a specific temperature. Such may increase the amount of vapors emitted as compared with conventional processing technologies, in addition to affording enhanced control over oil processing operations by providing a highly tunable system.

BACKGROUND

It is well known that oil is a critical commodity for modern societies. To meet this need, oil production is engaged in on a worldwide basis under a variety of conditions and using a variety of techniques. Petroleum reserves (e.g., extra heavy oil and bitumen) that were once passed over in favor of easier to extract reserves are now receiving considerably more attention than in the past, and in fact are the target of many extraction efforts in Canada and elsewhere. Indeed, the continued development of oil production techniques to increase the economic efficiency of oil production may be a constant goal of the oil production industry.

As is well known, crude oil and partially refined oil often may consist of two or more physical and/or chemical components or constituents. In many oil production applications, it may be desirable to process an oil so as to separate out such various physical and/or chemical constituents. Such separation may be desirable to recover oil components with separate uses that may have independent commercial value and/or to produce an oil at a well site that can be pumped for further processing elsewhere.

A key aspect of conventional oil production practices may be transporting oil by pumping it through pipelines. However, extra-heavy oils may not be able to be pumped in existing pipelines in their natural state due to their high densities and kinematic viscosities. Rather, these oils usually must be processed into pipeline-ready heavy oils. Pipeline-ready heavy oils may be defined as those having, at pipeline temperatures, densities above 19 degrees API and kinematic viscosities below 350 centistokes. Conventional techniques for processing extra-heavy oils into pipeline-ready heavy oils typically involve mixture with either natural gas condensate or lighter hydrocarbons to produce a blended oil that can be pumped. However, using the methods and apparatus of this disclosure, the need for a diluent to produce a blended oil may be eliminated and a directly pumpable oil may be produced instead.

DISCLOSURE OF INVENTION

Methods and apparatus are disclosed for possibly producing pipeline-ready heavy oil from substantially non-pumpable oil feeds. The methods and apparatus may be designed to produce such pipeline-ready heavy oils in the production field. Such methods and apparatus may involve thermal soaking of liquid hydrocabonaceous inputs to generate, though chemical reaction, an increased distillate amount as compared with conventional boiling technologies.

Accordingly, an object of the inventive technology may be the separation via physical and/or chemical processes of physical and/or chemical constituents of an oil.

Another object of the inventive technology may be to accomplish such separation using methods and apparatus involving thermal environment(s) in which an oil may be heated to a certain temperature for a residence time.

Still another object of the inventive technology may be a novel method of generating a pumpable oil (e.g., heavy oil) from a substantially non-pumpable oil (e.g., extra heavy oil or bitumen).

Another object of the inventive technology may be to increase vapor yields as compared with conventional oil processing technologies.

A further object of the inventive technology may be to provide such distillate recovery in conjunction with the use of methods and apparatus for producing heavy oil from non-pumpable oil feeds.

Yet another object of the inventive technology may be to provide a feed to a continuous coker.

Naturally, further objects of the inventive technology are disclosed throughout other areas of the specification, and claims when presented.

MODES FOR CARRYING OUT THE INVENTION

Figure 1:
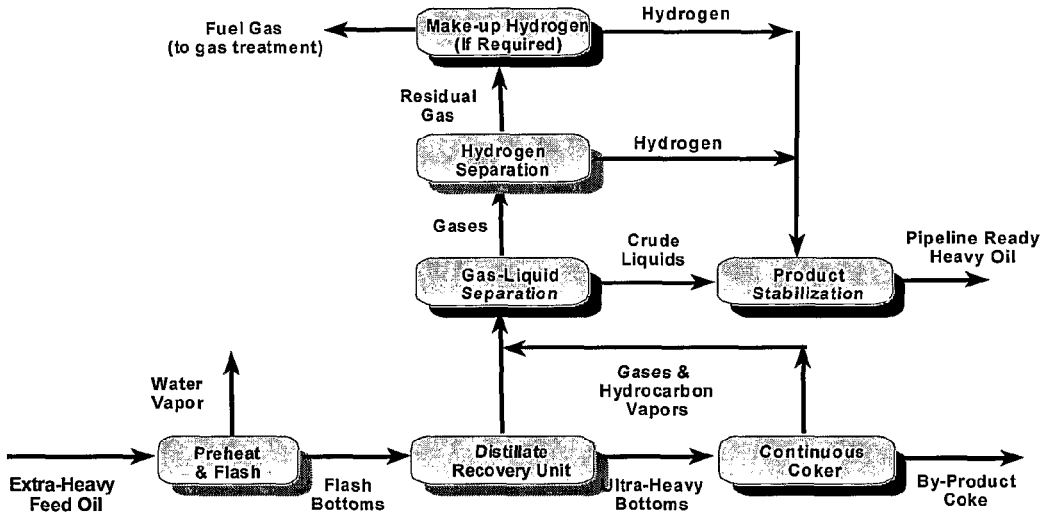
FIG. 1 is a block flow diagram showing a process for producing pipeline-ready heavy oil from extra-heavy feed oils.

The present inventive technology includes a variety of aspects, which may be combined in different ways. The following descriptions are provided to list elements and describe some of the embodiments of the present inventive technology. These elements are listed with initial embodiments, however it should be understood that they may be combined in any manner and in any number to create additional embodiments. The variously described examples and preferred embodiments should not be construed to limit the present inventive technology to only the explicitly described systems, techniques, and applications. Further, this description should be understood to support and encompass descriptions and claims of all the various embodiments, systems, techniques, methods, devices, and applications with any number of the disclosed elements, with each element alone, and also with any and all various permutations and combinations of all elements in this or any subsequent application.

Certain preferred embodiments of the inventive technology involve the processing of liquid hydrocarbonaceous material (more commonly referred to as oil). Specific embodiments may focus on the reduction of the viscosity of a feed oil so as to render it more amenable to pumping. Methods and apparatus are disclosed that in some embodiments of the inventive technology may produce pipeline-ready heavy oil from extra-heavy feed oils or bitumens. Indeed, some embodiments may input such substantially non-pumpable oil (e.g., one with a viscosity that is above a viscosity specification as specified by governing "code") and process it so as to yield a hydrocarbonaceous material with a lowered viscosity. Such non-pumpable oil may be a crude oil feedstock (e.g., extra heavy oil or bitumen), and processes to reduce viscosity may take place in the field, at a crude extraction site (e.g., a production site such as a well site). The process feed may be bitumen, or extra-heavy oil such as that which may be obtained when using steam-assisted technologies to produce non-upgraded bitumen from Canadian oil sands deposits or when producing extra-heavy oils such as those found in the Orinoco Belt in Venezuela.

In certain embodiments whose goal is to produce a pipeline ready oil, it may be affirmatively assured that a viscosity of an oil substantially matches that viscosity specified for pumpable oil (e.g., a maximum viscosity of an oil for it to be transported via pumping through pipes). Such may involve preparing a condensate having such a matching viscosity, or, perhaps preparing a condensate that has a viscosity that is less than such specified pumping oil viscosity and adding that condensate to an excessively viscous oil (e.g., a crude) so as to yield a pumpable oil (e.g., one having a substantially matching viscosity). Such pumpable oil may be referred to as pipeline ready, and may be often referred to as merely a heavy oil. Associated methods and apparatus may be designed to produce such pipeline-ready heavy oil in the production field and may eliminate the need for separately prepared condensate or light hydrocarbon diluents that are now typically used to make pumpable blends from ultra-heavy feedstocks.

One inventive aspect of certain embodiments of the technology herein described may relate to continual processing during operation. Indeed, certain embodiments may involve continuous input elements (e.g., a pump, pipe and an orifice) that continually input a hydrocarbonaceous material—as opposed to merely having batch mode operative capabilities. Such, of course, may improve efficiency of the overall process, perhaps reducing labor, power and heating costs as well.

Thermal environments (2) in which a liquid hydrocarbonaceous material may be held and heated for a residence time may be found (perhaps in serial arrangements) in particular embodiments. In such arrangements, the output of one thermal environment (e.g., bottoms) may serve as the input to the "next" thermal environment (e.g., that thermal environment that is immediately downflow). Thermal environment is intended as a broad term, and includes not only a vessel, but also any structure in which a liquid hydrocarbonaceous material can be held and heated. As such, one vessel may define two thermal environments, as where there is a weir (5) of sorts (a type of physical segregator) in that single vessel (see FIGS. 8, 9, 12 and 13). Such a weir may enable differential processing (e.g., heating to different temperatures and perhaps for different times) of oil held in segregated portions of the vessel. Of course, in keeping with the broad definition of oil (a liquid hydrocarbonaceous material), the liquid hydrocarbonaceous bottoms from a thermal environment is a type of oil.

Additionally, it should be noted that a thermal environment has a volumetric capacity (thereby enabling the holding of contents for a residence time so that they can be heated for that time). Of course, this capacity—the maximum amount of liquid hydrocarbonaceous materials that can be held and heated therein—need not be used in its entirety during processing (although, e.g., a vessel may indeed be filled to capacity during operation). Indeed, in coordinating aspects of the system such that a specific thermal environment holds an oil for a certain time as desired (a residence time), it may only be necessary to assure that, given a certain input rate of the liquid hydrocarbonaceous material and output rate of a portion of that material, the volumetric capacity not too small (e.g., the vessel is large enough given these specific constraints). As should be understood, aspects that may be coordinated so as to result in a desired residence time may include input rate, output rate, temperature of the thermal environment(s), and even pressure within the thermal environment (lower pressures may enhance volatility of constituents, e.g.). Indeed, given a certain temperature and residence time, too low an output rate may result in an increase in the volume of the oil in that thermal environment, and an eventual, undesired "overflow". Certainly it is also clear that the output rate of a thermal environment (referring to the non-gaseous and non-vaporous outputs) is typically lower than the input rate because of the hydrocarbonaceous materials that are vaporized or emitted as gas. It should also be noted that pressures of the thermal environments may vary to yield vaporous products as desired—pressures may be vacuum, atmospheric, or above atmospheric (including but not limited to slightly above atmospheric, such as substantially at 1%, 3%, 5%, 7%, 10%, 12% and 15%). Thermal environment temperatures can be low boiling point temperatures (e.g., less than 40° F., less than 70° F., less than 100° F., less than 150° F., less than 200° F., less than 250° F., less than 300° F., less than 370° F., less than 400° F., less than 450° F., less than 500° F., less than 550° F., less than 600° F., less than 650° F., less than 700° F., less than 710° F.).

That aspects of the inventive technology are able to yield greater processed hydrocarbons (e.g., those hydrocarbonaceous materials that are vaporized and subsequently condensed) than observed when conventional processing methods are used may be attributable to residence time. Essentially, the thermal soaking that takes place during the prolonged heating of the hydrocarbonaceous contents of the thermal environment(s) cracks constituent hydrocarbonaceous materials, thereby producing additional amounts of lighter hydrocarbonaceous materials that may then be vaporized. The chemical reaction may yield hydrocarbonaceous materials that, upon their appearance as a vapor, may have a condensation point that is less than or equal to the temperature to which the contents of the thermal environment are heated (which may be at least a hydrocarbonaceous material constituent boiling point temperature). Further, the molecules cracked may even be heavier than the heaviest molecules evaporated. Residence times may be selected based on data relative to the vaporous response at different residence times at a certain (or perhaps changing) temperature. Such data, whether in the form of graphs, charts, tables or in other form, may also be useful in coordinating aspects of the inventive apparatus and methods to yield products as intended. It should be noted that at some point, the additional yields due to cracking and subsequent vaporization diminish and there is little economic sense in holding and continuing to heat the oil at that temperature. Then, of course, it may be prudent to output the held oil to the next thermal environment (perhaps with a higher temperature to remove heavier hydrocarbons), or, perhaps to a coker (3).

Residence times for each thermal environment may be different, or indeed they may be similar to all or only some of other thermal environments that may exist. Residence times may be those residence times that result in a vapor yield as desired (which of course includes not only vaporization of hydrocarbonaceous material constituents, but also of those hydrocarbonaceous materials that are generated through cracking). An ideal residence time for a certain thermal environment may be less than that residence time which, at its completion (e.g., at the end of eight hours) does not crack hydrocarbonaceous molecules. However, there may be some time before the observance of absolutely no (or de minimus) cracking at which the "residential holding" should be terminated, for economic reasons. Of course, heating during the residence time is costly, and such costs will not be justified by the reduced vaporous returns, at some point in time. That point may vary, of course, perhaps depending on the hydrocarbonaceous material constituent (pentane, water, ethane, etc.) that a thermal environment intends to remove. Possible residence times include, but are not limited to: five minutes, fifteen minutes, one-half hour, one hour, two hours, three hours, four hours, five hours, six hours, seven hours, eight hours, nine hours, and ten hours.

It should be noted also there is, of course, a limit to the number of stages (each with an inlet and outlet, heat source (1) and its unique thermal environment) that are to be employed in a distillate recovery unit (7) perhaps referred to hereinafter as merely "unit"). Merely one of many different embodiments of such a unit is as Depending on perhaps the target viscosity (which may itself depend on the pumpable oil viscosity specification, the viscosity of the incoming crude, and whether a processed condensate yield is to be added to a substantially non-pumpable input crude, or instead pumped itself), the number of stages may vary (from perhaps one to twenty). However, other goals of the unit—and perhaps the coker also—including merely the preparation of a desired processed hydrocarbon, may govern the number of stages. In such manner, and given the overriding nature of economics in petroleum processing, such decisions may be made to result in desired processing economics. It will be noted, perhaps tangentially, that in keeping with the broad meaning that the term "distillate recovery unit" has assumed as used by the inventors, the term distillate recovery unit may apply even to those apparatus that do not effect recovery of a distillate (but perhaps instead merely effect recovery of a vapor that is subsequently condensed in a separate apparatus).

As is well known, a heat source can relate to any of a variety of manners in which a mass may be heated, including but not limited to natural gas, electrical, use of gas yielded during methane processing, burning of solid fuel, etc. Of course, the heat source may be adjustable so as to heat the oil in the thermal environments as desired. One heat source may heat more than one thermal environment, or one or more (or all) thermal environments may have its own heat source.

Certain embodiments of the inventive technology may include a vapor and gas collection system (which, in part or entirety, may be referenced as (6)). Indeed, whenever a condenser (4) acts on vapors, they are deemed to have been collected (thus, whenever the apparatus includes a condenser, it must include a vapor and gas collection system, even where that apparatus forms a part of the condenser, is one in the same with the condenser, or is separate from the condenser). Such apparatus are well known in the art, and include but are not limited to sweep gas systems (e.g., including those that use methane as a sweep gas) and that part of distilling trays or bubble caps (and perhaps other structural parts, such as any upper "ceiling" of the thermal environment(s) that may exist) that act to establish vapors such that they can be condensed. That sweep gas may be later removed from the collected gases and vapors, as is also well known in the art. Upper inlets are part of the vapor and gas collection system (which may further include, in at least one embodiment, a pressurized tank (9) of methane, as but one example). Of course, this methane may be recycled from its source as a product of other sub-processes in the system. As used herein, for purposes of clarity, the term vapor may refer to condensable mass while gas may refer to non-condensable mass. Further, it should be understood that a vapor and gas collection system is said to exist as long as vapors are collected (e.g., even where there are little or no gases collected).

Figure 14:
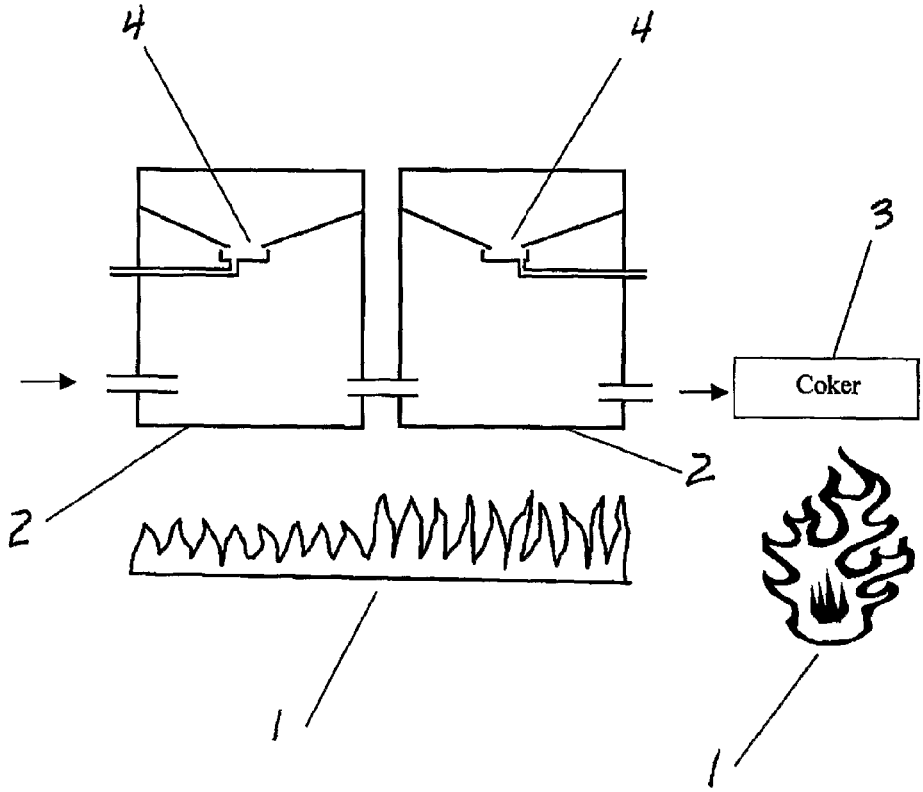
FIG. 14 shows one multistage embodiment of the inventive technology, with one vessel defining each of two thermal environments, and with one integral condenser corresponding to each thermal environment.
Figure 15:
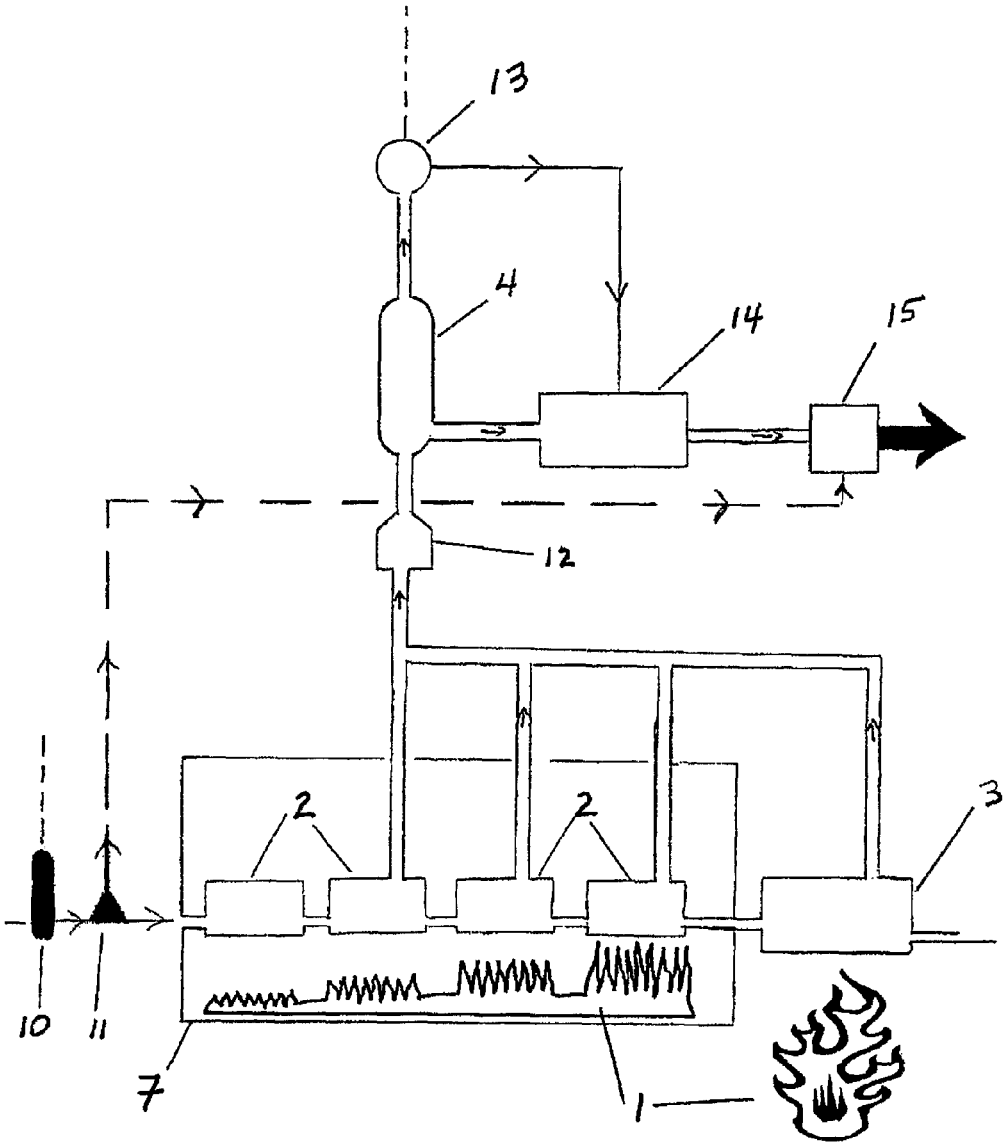
FIG. 15 shows a schematic representation of one embodiment of an inventive method to generate a pumpable oil from a substantially non-pumpable oil.

It should be understood that certain embodiments may include a condenser(s). As is well known, temperatures in a condenser may be sufficiently low to condense vapor(s) of interest. In keeping with the broad nature of the inventive technology, a condenser may correspond to (i.e., operate on the vapors of) more than one thermal environment. Indeed, one condenser may correspond to all thermal environments in a multistage distillate recovery unit. However, there may be one condenser for each thermal environment, or, in a single multistage unit, one or more thermal environments may have only one corresponding condenser, while one or more of the remaining thermal environments may have two or more corresponding condensers. Regardless, condensers (and vapor and gas collection system, for that matter) may be established integrally (see FIGS. 12-14) with the thermal environment with which they correspond (distilling tray(s) or bubble caps near the top thereof, as but two examples), or separately therefrom (see FIGS. 8-11).

In some embodiments, an inventive apparatus (which in some embodiments may be termed a distillate recovery unit) may heat the incoming bottoms (whether flash or otherwise) in stages, perhaps in some embodiments to remove lighter boiling hydrocarbons and perhaps to produce a bottoms stream that becomes progressively heavier. In certain embodiments, operating conditions in the distillate recovery unit may be varied over wide ranges perhaps to change both the quantity and the quality of the hydrocarbons leaving the system as liquids and vapors. For example, operating at short residence times (perhaps a minute or less) and at moderate temperatures (perhaps up to 650 or 700 F) may produce hydrocarbon vapors that may be characteristic of the normal boiling point ranges in the feed oil. Little or no chemical modification of the feedstock may be achieved and a purely physical separation may occur under such conditions. The resultant overhead yields from the thermal environments may possibly be estimated using the normal boiling point curve for the hydrocarbon of interest. However, longer residence times may indeed crack hydrocarbonaceous constituents, and yield an increase in the vaporous emissions as compared with those heating processes that do not involve a thermal soak.

Figure 2:
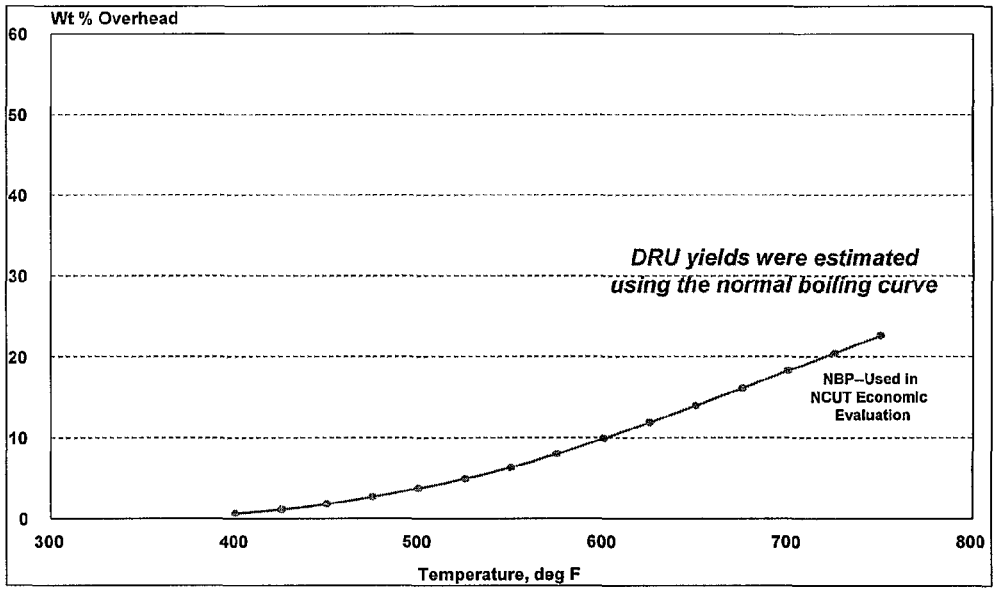
FIG. 2 is a graph showing the results of operation of one embodiment of an inventive unit at short residence times for certain embodiments of the inventive technology.

To illustrate this and related aspects of the inventive technology, particular reference is made to certain figures. FIG. 2 illustrates for one embodiment of the inventive technology the fraction of an incoming Cold Lake crude oil that may evaporate and possibly report overhead when the temperature of the boiling stage is held at temperatures perhaps varying between 400 to 750 F. In this instance, residence times in the thermal environments may possibly be less than five minutes, and an uncracked distillate product may be recovered from the overhead condensers. The quantity of material collected as overhead may agree with that expected from normal boiling point considerations.

Figure 3:
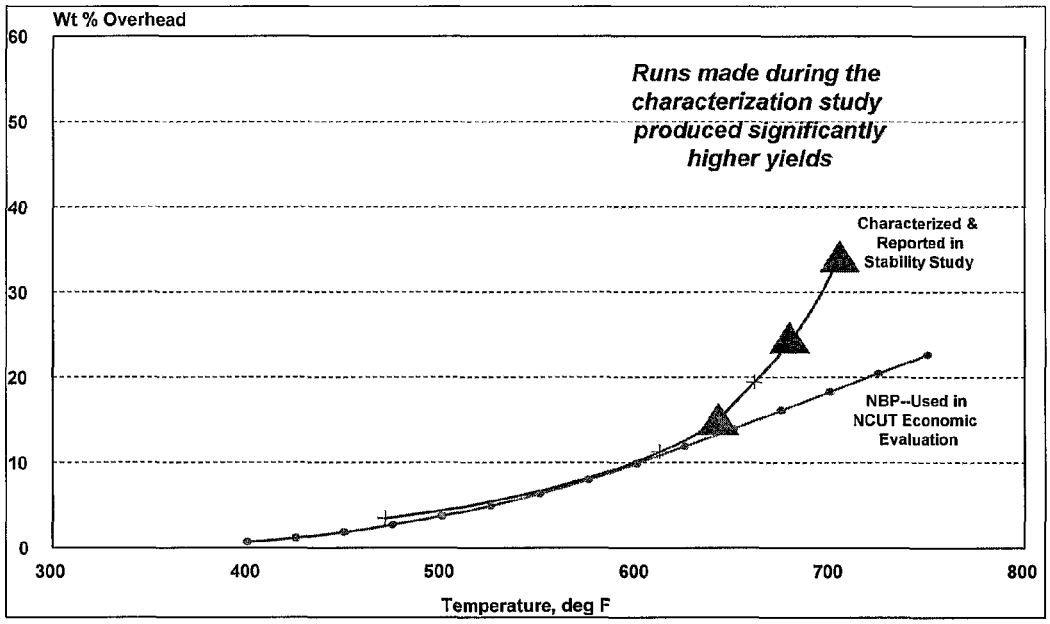
FIG. 3 is a graph showing the results of operation of one embodiment of an inventive unit at medium residence times for certain embodiments of the inventive technology.

FIG. 3 illustrates for one embodiment of the inventive technology that if the residence time in the boiling stage is increased from 1-5 minutes to 15-30 minutes, chemical alterations in the material flowing overhead may begin to occur. Significant departures from normal boiling behavior may begin to be noticed at thermal environment temperatures, perhaps above 675 F, and the yields of materials collected overhead may begin to increase dramatically.

Figure 4:
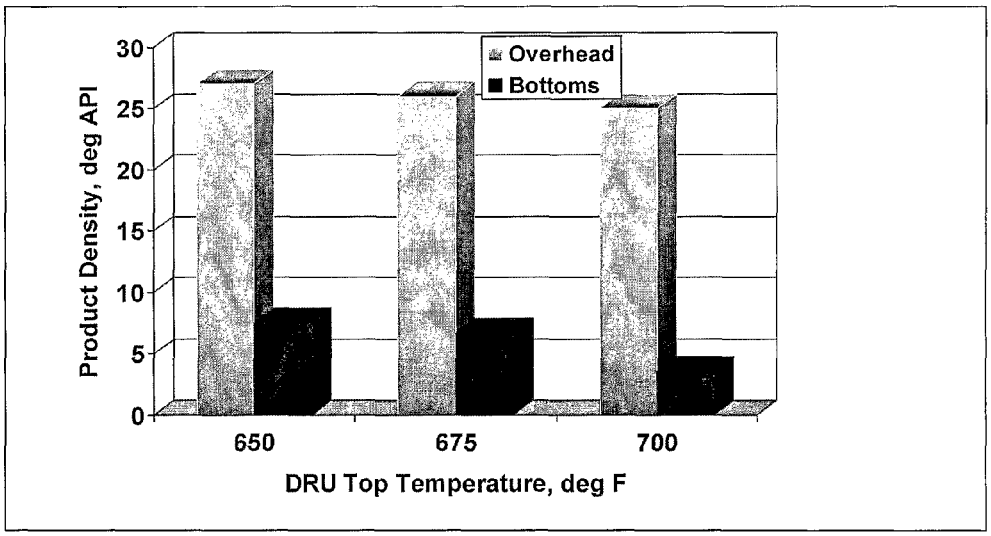
FIG. 4 is a graph showing the specific gravity of overhead distillate produced by a unit operating at medium residence times for certain embodiments of the inventive technology.

FIG. 4 illustrates for one embodiment of the inventive technology that the specific gravity of the distillate product produced by operation at medium residence times may not appear to vary with thermal environment temperature, although the density of the bottoms output from thermal environments may appear to do so. As may be expected, the bottoms may become heavier as lighter materials are perhaps progressively removed. The possible constancy in overhead product quality may be suggestive of progressively greater cleavage of carbon-sulfur bonds as the still temperature is raised.

Figure 5:
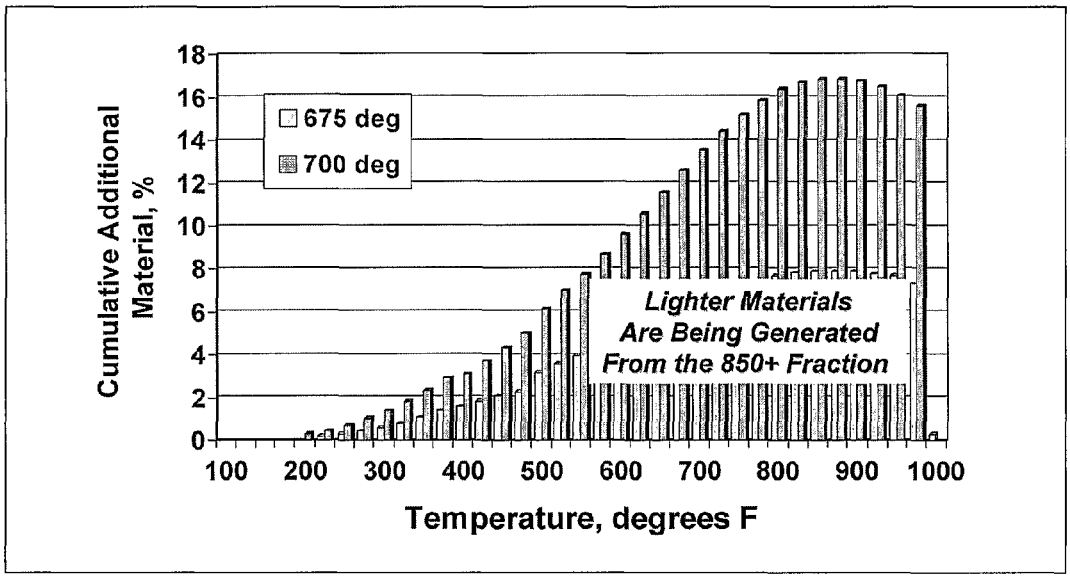
FIG. 5 is a graph showing differential mass balances by boiling point fraction produced by a unit for certain embodiments of the inventive technology.
Figure 6:
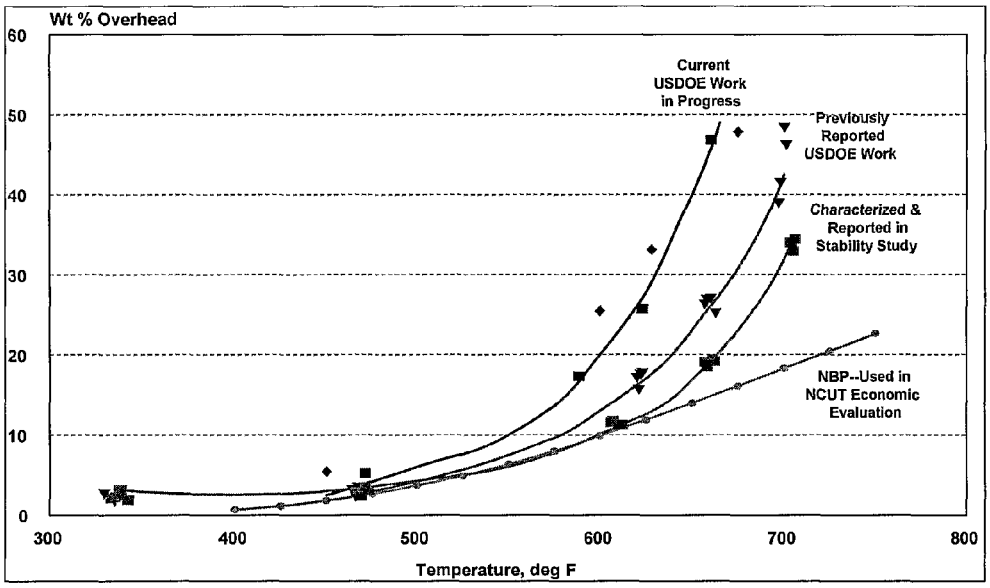
FIG. 6 is a graph showing the yield of overhead at various temperatures and residence times produced by a unit for certain embodiments of the inventive technology.

FIGS. 5 and 6 illustrate for one embodiment of the inventive technology that as residence times may be increased first to an hour and then to two hours, the improvements in overall overhead yield may continue to be realized. A "trade-off" may exist between residence time and temperature, however, and maximum yields may only be achieved at long residence times.

Figure 7:
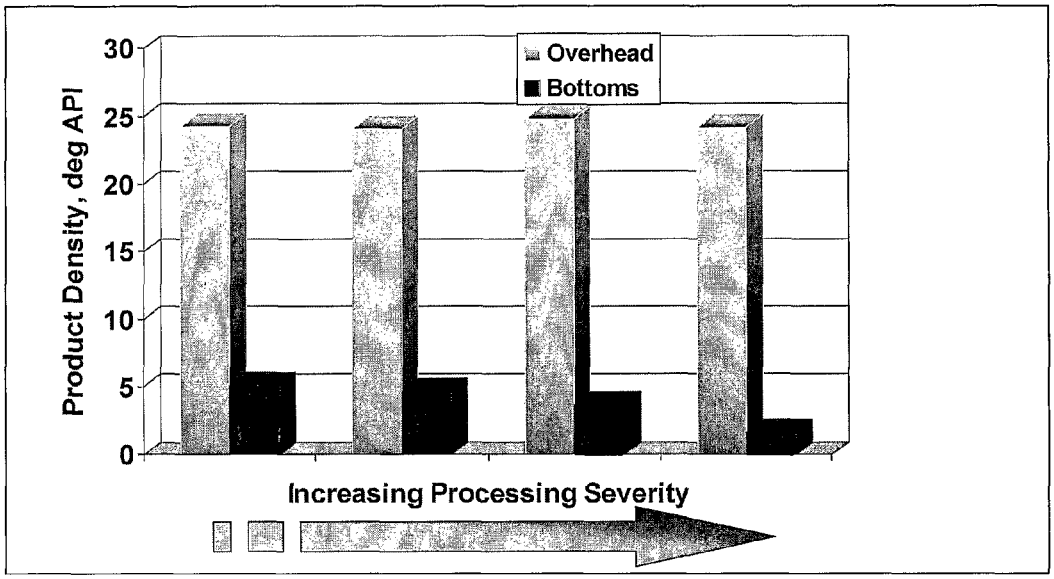
FIG. 7 is a graph showing density variations produced by a unit for certain embodiments of the inventive technology.
Figure 8:
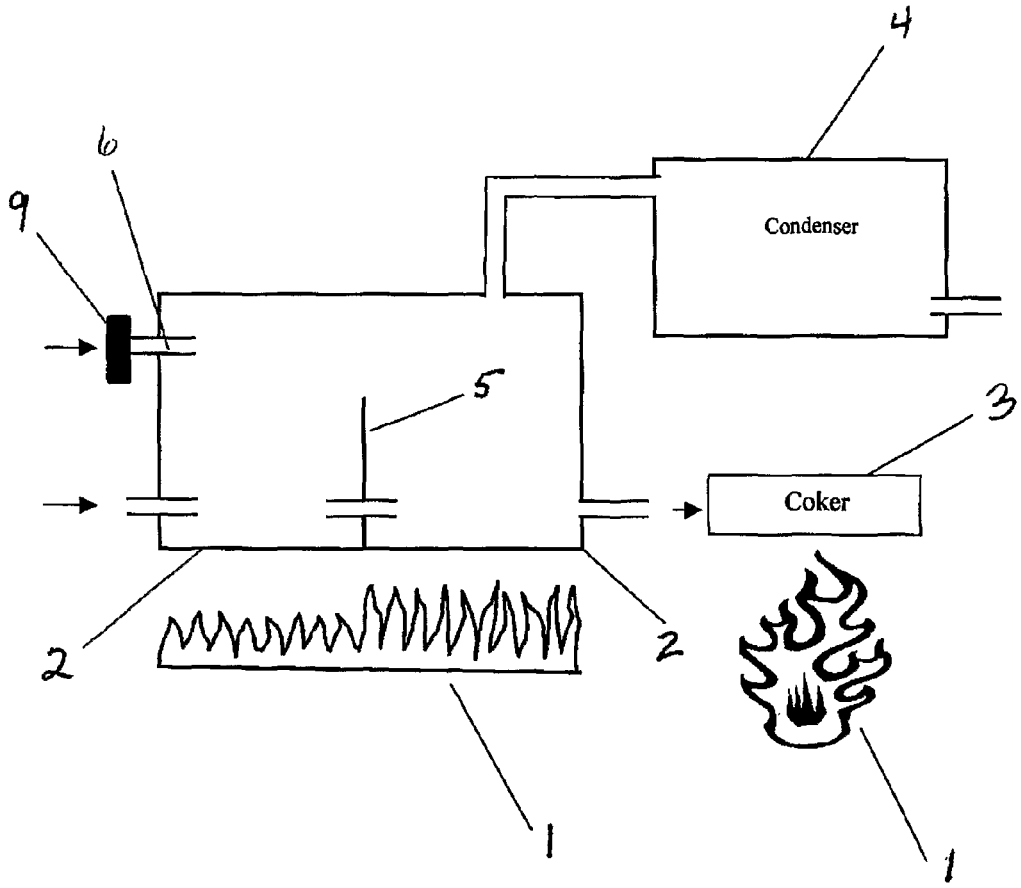
FIG. 8 shows one multistage embodiment of the inventive technology, with one vessel and weir defining two thermal environments, and with one separate condenser for both thermal environments.
Figure 9:
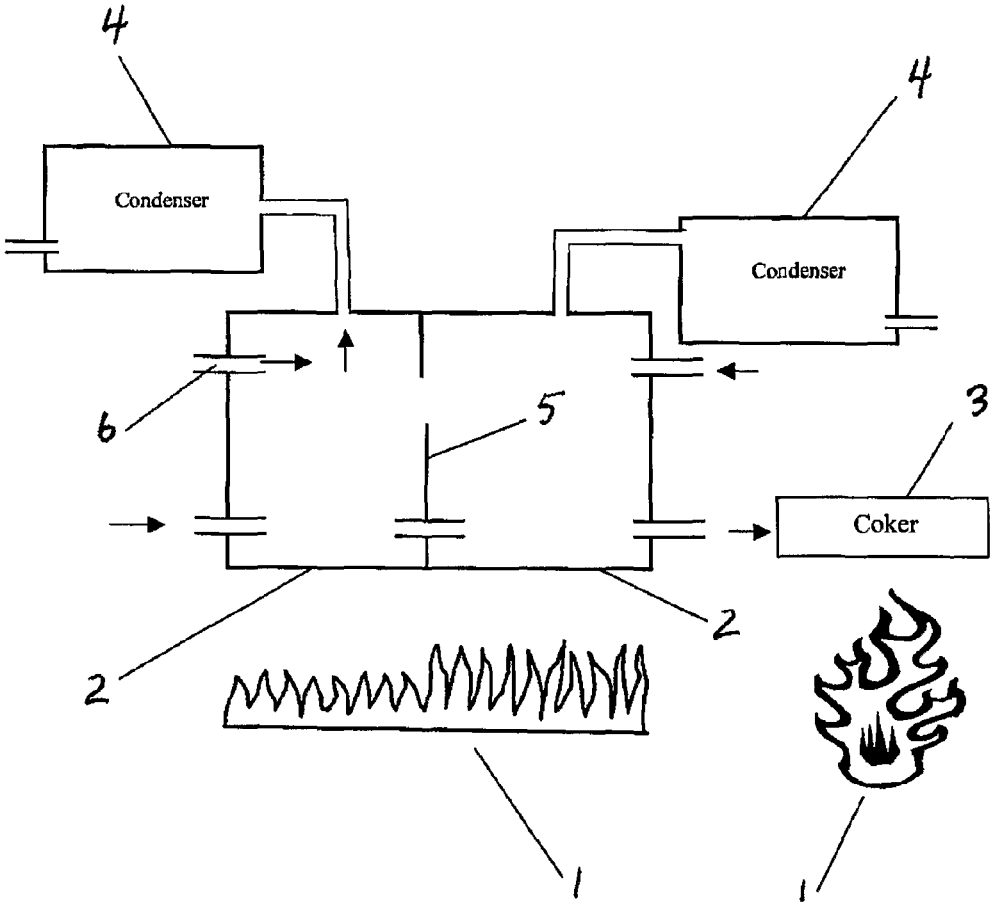
FIG. 9 shows one multistage embodiment of the inventive technology, with one vessel and weir forming two thermal environments, and with one separate condenser for each thermal environment.
Figure 10:
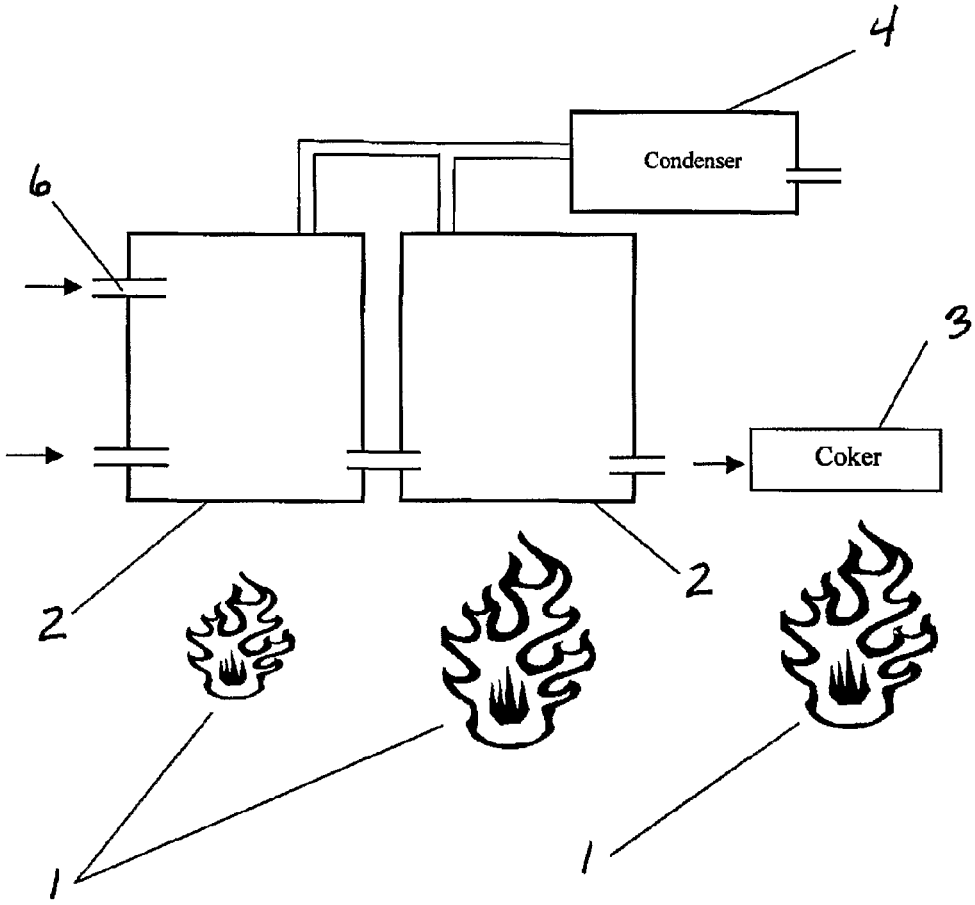
FIG. 10 shows one multistage embodiment of the inventive technology, with one vessel defining each thermal environment, and with one separate condenser corresponding to both thermal environments.
Figure 11:
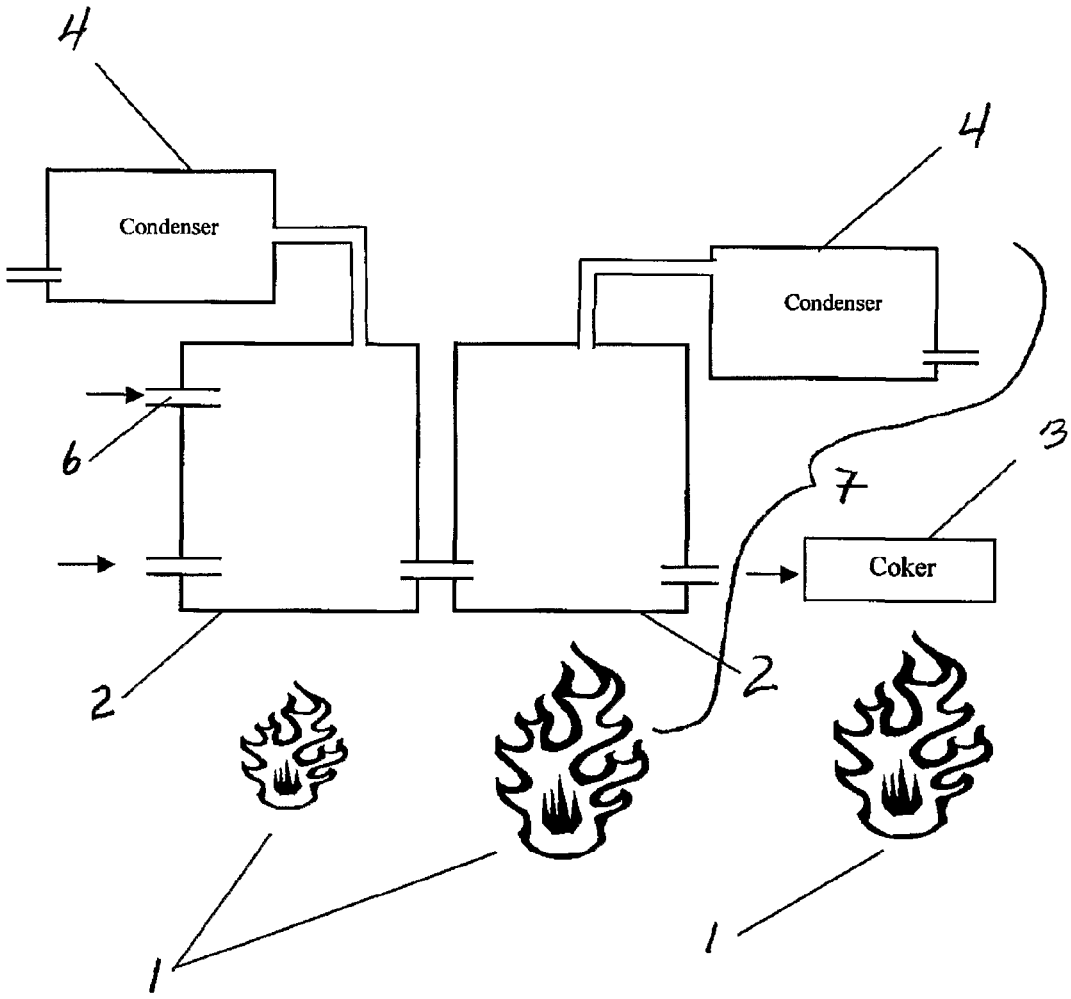
FIG. 11 shows one multistage embodiment of the inventive technology, with one vessel defining each of two thermal environments, and with one separate condenser for each thermal environment.
Figure 12:
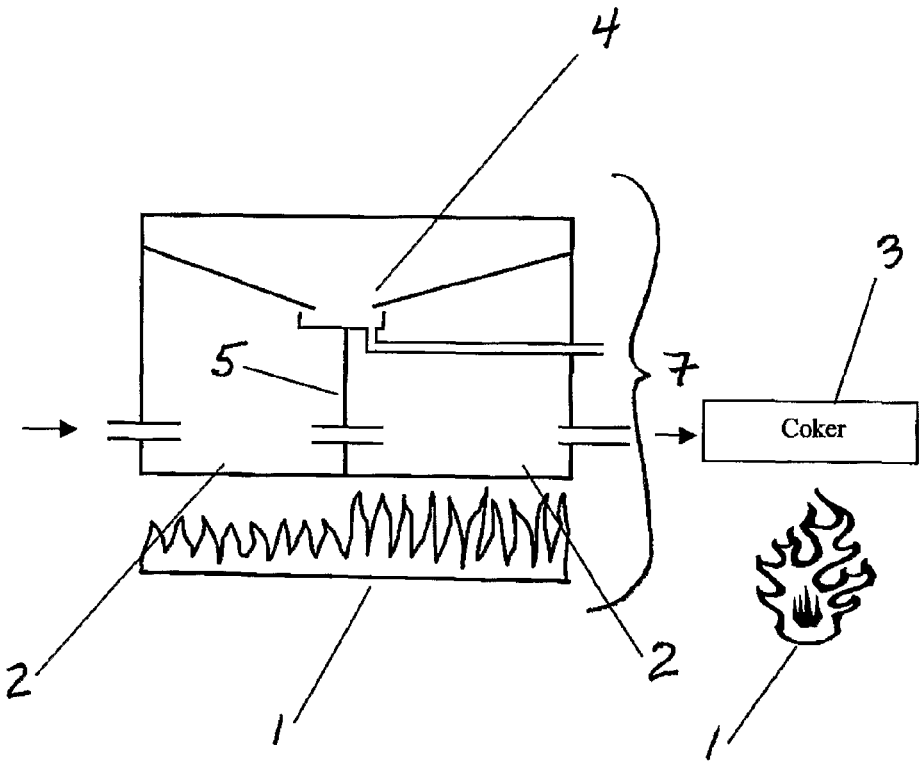
FIG. 12 shows one multistage embodiment of the inventive technology, with one vessel and weir defining two thermal environments, and with one integral condenser.
Figure 13:
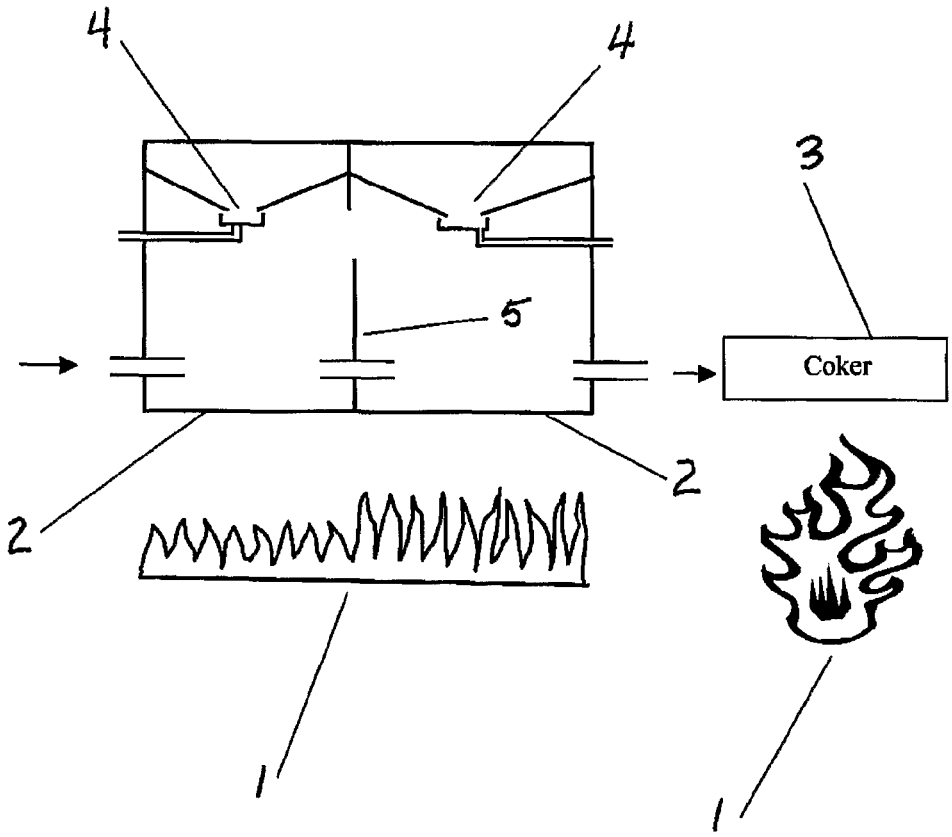
FIG. 13 shows one multistage embodiment of the inventive technology, with one vessel and weir defining two thermal environments, and with two integral condensers.

FIG. 7 illustrates for one embodiment of the inventive technology that the trends which may have been observed earlier with respect to the specific gravities of the overhead product and the thermal environment bottoms may continue as residence times are increased. This may allow considerable flexibility in the design and layout of inventive units.

In some embodiments, perhaps depending upon the temperature and residence time of a thermal stage in the distillate recovery unit, the hydrocarbon liquids and vapors emerging from the stage may be indicative of perhaps simple boiling at one extreme to perhaps substantial cracking of the heavier hydrocarbons to lighter products at the other. The degree to which either extreme is utilized in an operating system may be a function of its design. Full exploitation of the phenomena may enable custom-designed equipment to be perhaps highly and selectively optimized (tuned) for a given feedstock.

Of course, one of the goals of certain embodiments of the inventive technology is to remove from a hydrocarbonaceous material input (e.g., an unprocessed crude oil) certain constituents thereof. Particular embodiments may focus on the removal of light hydrocarbons (e.g., those with relatively low boiling points). However, these and other embodiments may include a water removal stage that typically would appear as the first stage of a multistage processing unit. Such stage (which preferably would include a thermal environment) would heat incoming hydrocarbonaceous material to vaporize liquid water which, although not a hydrocarbaonaceous material, often is a hydrocarbonaceous material constituent—particularly when that material is an unprocessed crude. Embodiments with such a water evaporization stage may include a thermal environment (e.g., having a holding capability), but certainly there may be other manners in which water may be evaporated from a "wet" crude (e.g., free expansion (see 10), settling tank, non-retentive heating)—whether within or outside of the unit. In certain embodiments, water may be removed from an incoming oil to generate an anhydrous oil, and subsequently such "dry" oil may be input to the inventive processing unit.

Again, the feed to the process might not need to be free of water (or solids, for that matter). Indeed it may possibly contain up to 10% water or 20% BS&W if the water content is below 10%. In those embodiments where the input to the processing unit is anhydrous, the water may have been removed by a free expansion, or perhaps a settling tank (or simple heating and vaporization).

When free expansion water removal techniques are used, the feed may be first pressurized to perhaps as much as 800 psia and then heated to temperatures perhaps as high as 650 F. This hot pressurized stream may then be expanded to atmospheric pressure using free expansion, possibly through a valve (Joule-Thompson expansion), during which the water may be flashed off, then possibly leaving the system as a benign vapor. The optimal combination of pressure and temperature in this sub-process may depend upon the water content of the incoming feed. It may be that the greater the water content, the higher the pressure and temperature required to effect its release. The warm, anhydrous flash bottoms that may be left after the removal of the water then may be fed to the processing unit (with its thermal environments) for further processing.

Certain embodiments may include a coker. Typically, such a coker would be continuous (as opposed to only batch-mode operable), and may involve physical agitation (due to, perhaps, an auger), a feature that typically is not found in thermal environments found in the unit itself. A description of a continuous coker that might find application in the overall apparatus may be found in U.S. Pat. No. 6,972,085, issuing 6 Dec. 2005, hereby incorporated herein by reference. For optimal operation, such continuous coker may include a liquid level control that allows the coker to maintain a constant liquid level (even when the feed rate changes). Such a control could be achieved, for example, by a properly sized and situated downcomer.

Certain inventive methods may include the step of generating a condensed combination of vapors yielded during holding steps. Such generation may take place with a condensate generation apparatus, that may be: (a) in either order, a condenser, and a combiner (that combines either vapors or condensate, as appropriate depending on whether it is up or downstream of the condenser(s); or (b) a condenser that receives uncombined vapors (from one or more thermal environments) and combines them itself, internally. Explained in terms of corollary method steps, such aforementioned "generating" step may be done either by first combining vapors from more than one thermal environment and then condensing them, or by first condensing vapors in more than one condenser (e.g., one condenser corresponding to each thermal environment) and then combining the condensate, or by using one condenser acting on vapors that are separate before their input to the condenser.

Of course, to yield different hydrocarbonaceous constituent condensates, different thermal environments may have different temperatures. Typically, temperatures of thermal environments would increase as the hydrocarbonaceous material travels downstream, encountering different thermal environments. However, if the intent of the unit is merely to create a pumpable (e.g., "on spec") condensate, then it may not be necessary to remove certain heavier hydrocarbonaceous material constituents. Further, given the constraints of a particular processing problem to be solved, one might only want to yield constituents having a certain "weight" or less (e.g., pentanes and lighter).

Certain embodiments may comprise a condensate admixing apparatus (15) that dilutes a substantially non-pumpable oil to a viscosity that is at or perhaps below a specification viscosity by adding a lower viscosity material (e.g., a processed condensate) to an "out of spec" oil (e.g., a crude whose viscosity is greater than a viscosity specification). Such embodiments may involve a sidestream fraction withdrawal system (11) that may withdrawal from an incoming crude a flow to be processed (or a flow to which a processed, lower viscosity condensate is to be added). A substantially non-pumpable oil may be an oil that has a viscosity that is greater than a pumpable oil viscosity specification (which may be a maximum viscosity). Further, although it may be correct that for a liquid to be properly pumpable indices other than viscosity may need to be at a specified value or within a specified range, processing an excessively viscous liquid so that it is pumpable (even where that processing involves only the addition of a diluent prepared from a sidestreamed fraction) will involve a decrease in viscosity. Further steps, at least some of which are well known in the art, may need to be taken to render an oil that is entirely "on-specification" for pumping.

In some embodiments, the processing unit may heat the incoming bottoms (whether flash or otherwise) in stages (each stage characterized primarily by a thermal environment) to possibly remove lighter boiling hydrocarbons and to possibly produce a bottoms stream that becomes progressively heavier. In various embodiments, operating conditions in the unit may be varied over wide ranges to perhaps change both the quantity and the quality of the hydrocarbons leaving the system as liquids and vapors. For example (as mentioned above), in one embodiment, operating at short residence times (perhaps a minute or less) and at moderate temperatures (perhaps up to 650 or 700 F) may produce hydrocarbon vapors characteristic of the boiling point ranges in the feed oil. Little or no chemical modification may occur and a purely physical separation may be achieved. In other embodiments, as processing severity may be increased, more and more chemical alteration of the boiling liquid may occur and the nature of the overhead product may change. Also, as alluded to above, it may be that the product composition from the processing unit may vary with the nature of the feed and may be altered by changing the operating parameters of the system. The bottoms from the unit may be referred to as ultra-heavy since its density may be considerably greater than that of the process feed. For example, in some embodiments, when the incoming feed is an oil with a density of 10-12 degrees API, not infrequently the API density leaving the unit may be negative and may have a specific gravity greater than unity.

Any ultra-heavy bottoms from the processing unit may be fed to a coking unit (a coker) where they may be thermally processed under even higher severity to perhaps produce coke, and possibly additional lighter gases and vapors. In some embodiments, a rotary unit (including an auger, e.g.) capable of continuous feed for achieving this function may perhaps be appropriate for this application. Such a coker may be as described in U.S. Pat. No. 6,972,085. In other embodiments, should such a device not be available or appropriate for use, either fluid coking or delayed coking may be used instead. Regardless, the control afforded over the upstream processing may provide an enhanced degree of control over the quantity and quality of coke produced by the continuous coker.

In some embodiments, additional steps may be taken, depending perhaps on the desired end product quality. The vapors leaving the coking unit and the processing unit may be combined, perhaps recompressed (12), and maybe then sent to a gas-liquid separation system (e.g., a condenser). In some embodiments, these vapors perhaps may be cooled by indirect heat exchange, possibly against cooling water, and the condensate may be collected in knock-out (KO) pots, perhaps either in stages or possibly as a combined product. Perhaps depending upon system pressure and overall economics, it may be feasible to recover by-product LPG at this stage. Similarly, perhaps depending upon the operating severity of the distillate recovery and the coking units, these vapors may possibly contain significant quantities of olefins that in some embodiments may warrant recovery as a process by-product. From this stage, non-condensable gases may flow to the hydrogen separation system (13) and the crude liquids may perhaps be sent to the product stabilization unit (14). Such unit might saturate the olefins and di-olefins upon, perhaps, mildly hydrotreating of the naptha fraction.

In some embodiments, the gases entering the hydrogen separation system may consist predominantly of $C_1$ through $C_4$ hydrocarbons perhaps along with hydrogen, hydrogen sulfide, and traces of carbon oxides. As hydrogen may be necessary for product stabilization, its recovery and recycle here may be warranted. Hydrogen separation from the bulk gas mixture may be accomplished by compression (or re-compression) possibly followed by either membrane separation or perhaps pressure-swing adsorption over five angstrom or smaller molecular sieves.

In some embodiments, off-gases from the hydrogen separation system, now perhaps substantially depleted of hydrogen, and perhaps also depleted of olefins and $C_3^+$ components, may be processed further for additional hydrogen possibly by either steam reforming or partial oxidation, or may possibly be used as a fuel perhaps to power a small gas turbine providing plant and/or electrolyzer power for hydrogen production, or possibly may be flared. Depending upon perhaps the degree of prior processing and possibly the overall operating severity of the previous steps, greater or lesser amounts of $H_2S$ and acid gas removal may be necessary. The naphtha fraction ($C_4$ to 400 F) of the liquids produced may contain olefins and di-olefins produced during processing in the distillate recovery and coking units. These compounds may have to be saturated by hydrotreating prior to admission to a pipeline.

It should be noted that as many embodiments of the inventive technology remove heavy, tarry substances (primarily as bottoms) from certain oils, such embodiments may find application wherever it is desired to clean an oil. As such, embodiments may find particular application in cleaning of oil field tank bottoms.

It should be understood that, as mentioned, the inventive technology includes different embodiments, each relating to different combinations of elements and features mentioned in this application. Such elements/features include, but are not limited to: thermal environments in which a hydrocarbonaceous material may be heated to a certain temperature and for a residence time; vapor and gas collection system (including a sweep gas system, as but one example); water removal systems (which may simply be a thermal environment adapted to heat a hydrocarbonaceous material in a thermal environment to a specific liquid water boiling temperature, perhaps for a specific residence time); stages that are each characterized by a specific thermal environment, where stages are serially established, with the thermal environments of downstream stages accepting as input at least a portion of the bottoms output by the thermal environment of an upstream stage, and with temperatures of the thermal environments increasing with each successive stage; condenser (s), whether integrated as part of each thermal environment or established separately from a corresponding thermal environment, and whether acting on the vapors of one, some, or perhaps even all thermal environments; hydrotreater(s); hydrogen separation unit(s) that act on materials heated in thermal environment(s); sidestream fractioning apparatus (particularly where an oil to be processed into a less viscous condensate is withdrawn from a substantially non-pumpable hydrocarbonaceous material such as extra heavy oil or bitumen); recycling apparatus (including, but not limited to those apparatus adapted to deliver hydrogen for re-use, or non-condensible gas yielded from a coking operation); those systems adapted to continually input and/or output hydrocarbonaceous materials (as opposed to batch-mode processing); generating a diluent from the same feedstock—a substantially non-pumpable one—to which it is subsequently added in order to prepare a pumpable oil; application of technologies (known and inventive) in the field (e.g., on the surface in the vicinity of an oil extraction site such as an oil well). Indeed, certain embodiments of the inventive technology may relate to combinations or permutations of all or only some of these—and perhaps other—features.

It should be noted that additional features and additional discussion of features disclosed herein may be found in Exhibit A, attached hereto, said exhibit incorporated herein by reference. Further, as this technical report presents observations based on processing response data, it focuses primarily only on specific application-type examples of the inventive technology. As such, it should be understood that, although the descriptions provided in Exhibit A may be couched in constraining language that might appear to exclude alternatives, this description is only of a specific embodiment(s) and should not preclude in any manner the use of substitutes, nor preclude the omission of certain steps, devices or structures.

Of course, as oil processing technology is rather extensively developed, several aspects of known processing involve adjusting certain parameters (e.g., flow rate). In this sense, some aspects of the inventive technology continue is this "tradition", and even reflect an advance over oil processing adjustment technologies. Particularly, aspects of the present technology relate to a highly tunable system (or subsystems, such as one or more stages or the coking operation) where quantities and quality (e.g., viscosity) of outputs and products (e.g., condensate) can be affirmatively controlled, and in perhaps predictable fashion, upon manipulation of adjustable parameters (e.g., residence time and thermal environment temperature). In such a tunable system, residence times, temperatures, number of thermal environments, and/or flow rates (as but a few operational parameters) can be manipulated to yield vapors, condensate, coke, non-condensable gas, and/or bottoms as desired. One of ordinary skill in the art of oil processing would, upon reading this specification, know of at least one manner of making systems that allow for the indicated adjustment or tuning capabilities.

It should be understood that this disclosure is intended to provide not only adequate support for claimed subject matter as originally filed, but also for subject matter that has an intended purpose, goal or general characterization that is different from that described in any preambles of those originally filed claims. For example, certain embodiments that are indicated as relating to a viscosity reduction apparatus or method may also be usable in other (perhaps broader) contexts (e.g., merely distillate recovery, or oil processing generally).

It should also be understood that one of ordinary skill in the art of oil processing—again, a highly developed art—would understand how to make and use claimed subject matter upon reading this specification. The technological advancements described and/or claimed herein are novel and non-obvious, but how they are made and used may be well within the ken of a highly trained ordinary oil processing artisan after reading this specification. For example, thermally soaking a continuously input crude feedstock to generate a hydrocarbonaceous material to be delivered to a coker may be novel and non-obvious, but manners of making and using such a system, as claimed—including perhaps how to use boiling point curves and other data assemblages (already known or perhaps provided herein) to estimate those temperatures and residence times that yield condensate fractions as desired—may be known to or readily ascertainably by one of ordinary skill in the art. Further, and as but one additional example, how to make that aspect of a system that reflects any descriptive limitation of claimed subject matter relative to coordination of flow rates and volumetric capacities to yield residence times as intended would be within the ken of an ordinarily skilled oil processing artisan upon reading this description. Manufacturing certain claimed systems may involve, in greater or entire part, merely well know piping, pressurization, heating, condensing, cooling, and other techniques—even though the systems themselves are inventive. It simply is impractical—and unnecessary—to describe in detail how to make and use every aspect of the inventive technology, particularly when the vast capabilities of one trained in this extensively developed field would know how to enable many of the features of claimed subject matter even without reading the description (e.g., a material may be input via piping).

As can be easily understood from the foregoing, the basic concepts of the present inventive technology may be embodied in a variety of ways. It involves both oil processing techniques as well as devices to accomplish the appropriate processing. In this application, the processing techniques are disclosed as part of the results shown to be achieved by the various devices described and as steps which are inherent to utilization. They are simply the natural result of utilizing the devices as intended and described. In addition, while some devices are disclosed, it should be understood that these not only accomplish certain methods but also can be varied in a number of ways. Importantly, as to all of the foregoing, all of these facets should be understood to be encompassed by this disclosure.

The discussion included in this patent is intended to serve as a basic description. The reader should be aware that the specific discussion may not explicitly describe all embodiments possible; many alternatives are implicit. It also may not fully explain the generic nature of the inventive technology and may not explicitly show how each feature or element can actually be representative of a broader function or of a great variety of alternative or equivalent elements. Again, these are implicitly included in this disclosure. Where the inventive technology is described in device-oriented terminology, each element of the device implicitly performs a function. Apparatus claims may not only be included for the device described, but also method or process claims may be included to address the functions the inventive technology and each element performs. Neither the description nor the terminology is intended to limit the scope of the claims that will be included in any subsequent patent application.

It should also be understood that a variety of changes may be made without departing from the essence of the inventive technology. Such changes are also implicitly included in the description. They still fall within the scope of this inventive technology. A broad disclosure encompassing both the explicit embodiment(s) shown, the great variety of implicit alternative embodiments, and the broad methods or processes and the like are encompassed by this disclosure and may be relied upon when drafting the claims for any subsequent patent application. It should be understood that such language changes and broader or more detailed claiming may be accomplished at a later date (such as by any required deadline) or in the event the applicant subsequently seeks a patent filing based on this filing. With this understanding, the reader should be aware that this disclosure is to be understood to support any subsequently filed patent application that may seek examination of as broad a base of claims as deemed within the applicant's right and may be designed to yield a patent covering numerous aspects of the inventive technology both independently and as an overall system.

Further, each of the various elements of the inventive technology and claims may also be achieved in a variety of manners. Additionally, when used or implied, an element is to be understood as encompassing individual as well as plural structures that may or may not be physically connected. This disclosure should be understood to encompass each such variation, be it a variation of an embodiment of any apparatus embodiment, a method or process embodiment, or even merely a variation of any element of these. Particularly, it should be understood that as the disclosure relates to elements of the inventive technology, the words for each element may be expressed by equivalent apparatus terms or method terms—even if only the function or result is the same. Such equivalent, broader, or even more generic terms should be considered to be encompassed in the description of each element or action. Such terms can be substituted where desired to make explicit the implicitly broad coverage to which this inventive technology is entitled. As but one example, it should be understood that all actions may be expressed as a means for taking that action or as an element which causes that action. Similarly, each physical element disclosed should be understood to encompass a disclosure of the action which that physical element facilitates. Regarding this last aspect, as but one example, the disclosure of a "condenser" should be understood to encompass disclosure of the act of "condensing"—whether explicitly discussed or not—and, conversely, were there effectively disclosure of the act of "condensing", such a disclosure should be understood to encompass disclosure of a "condenser" and even a "means for condensing" Such changes and alternative terms are to be understood to be explicitly included in the description.

Any acts of law, statutes, regulations, or rules mentioned in this application for patent; or patents, publications, or other references mentioned in this application for patent are hereby incorporated by reference. In addition, as to each term used it should be understood that unless its utilization in this application is inconsistent with a broadly supporting interpretation, common dictionary definitions should be understood as incorporated for each term and all definitions, alternative terms, and synonyms such as contained in the Random House Webster's Unabridged Dictionary, second edition are hereby incorporated by reference. Finally, all references listed in the list of References To Be Incorporated By Reference In Accordance With The Provisional Patent Application or other information statement filed with the application are hereby appended and hereby incorporated by reference, however, as to each of the above, to the extent that such information or statements incorporated by reference might be considered inconsistent with the patenting of this/these inventive technology(s) such statements are expressly not to be considered as made by the applicant(s).

Thus, the applicant(s) should be understood to have support to claim and make a statement of inventive technology to at least: i) each of the processing devices as herein disclosed and described, ii) the related methods disclosed and described, iii) similar, equivalent, and even implicit variations of each of these devices and methods, iv) those alternative designs which accomplish each of the functions shown as are disclosed and described, v) those alternative designs and methods which accomplish each of the functions shown as are implicit to accomplish that which is disclosed and described, vi) each feature, component, and step shown as separate and independent inventive technologys, vii) the applications enhanced by the various systems or components disclosed, viii) the resulting products produced by such systems or components, ix) each system, method, and element shown or described as now applied to any specific field or devices mentioned, x) methods and apparatuses substantially as described hereinbefore and with reference to any of the accompanying examples, xi) the various combinations and permutations of each of the elements disclosed, and xii) each potentially dependent claim or concept as a dependency on each and every one of the independent claims or concepts presented.

In addition and as to computer aspects and each processing aspect amenable to programming or other electronic automation, the applicant(s) should be understood to have support to claim and make a statement of inventive technology to at least: xii) processes performed with the aid of or on a computer as described throughout the above discussion, xiv) a programmable apparatus as described throughout the above discussion, xv) a computer readable memory encoded with data to direct a computer comprising means or elements which function as described throughout the above discussion, xvi) a computer configured as herein disclosed and described, xvii) individual or combined subroutines and programs as herein disclosed and described, xviii) the related methods disclosed and described, xix) similar, equivalent, and even implicit variations of each of these systems and methods, xx) those alternative designs which accomplish each of the functions shown as are disclosed and described, xxi) those alternative designs and methods which accomplish each of the functions shown as are implicit to accomplish that which is disclosed and described, xxii) each feature, component, and step shown as separate and independent inventive technologys, and xxiii) the various combinations and permutations of each of the above.

With regard to claims whether now or later presented for examination, it should be understood that for practical reasons and so as to avoid great expansion of the examination burden, the applicant may at any time present only initial claims or perhaps only initial claims with only initial dependencies. Support should be understood to exist to the degree required under new matter laws—including but not limited to European Patent Convention Article 123(2) and United States Patent Law 35 USC 132 or other such laws—to permit the addition of any of the various dependencies or other elements presented under one independent claim or concept as dependencies or elements under any other independent claim or concept. In drafting any claims at any time whether in this application or in any subsequent application, it should also be understood that the applicant has intended to capture as full and broad a scope of coverage as legally available. To the extent that insubstantial substitutes are made, to the extent that the applicant did not in fact draft any claim so as to literally encompass any particular embodiment, and to the extent otherwise applicable, the applicant should not be understood to have in any way intended to or actually relinquished such coverage as the applicant simply may not have been able to anticipate all eventualities; one skilled in the art, should not be reasonably expected to have drafted a claim that would have literally encompassed such alternative embodiments.

Further, if or when used, the use of the transitional phrase "comprising" is used to maintain the "open-end" claims herein, according to traditional claim interpretation. Thus, unless the context requires otherwise, it should be understood that the term "comprise" or variations such as "comprises" or "comprising", are intended to imply the inclusion of a stated element or step or group of elements or steps but not the exclusion of any other element or step or group of elements or steps. Such terms should be interpreted in their most expansive form so as to afford the applicant the broadest coverage legally permissible.

Finally, any claims set forth at any time are hereby incorporated by reference as part of this description of the inventive technology, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon.

What is claimed is:

1. A hydrocarbonaceous material upgrading method comprising the steps of:

inputting a first substantially unpumpable at pipeline conditions hydrocarbonaceous feedstock into a reactor, said first substantially unpumpable hydrocarbonaceous feedstock having a first viscosity, a first density, and a feedstock weight, wherein said first substantially unpumpable hydrocarbonaceous feedstock has a pour point;

heating, in said reactor and at an operating pressure from vacuum to slightly above atmospheric pressure (psig), said first substantially unpumpable hydrocarbonaceous feedstock to a reactor temperature and for a residence time from one to eight hours, wherein said reactor temperature is at least a first hydrocarbonaceous material constituent boiling point temperature;

vaporizing, under said operating pressure, at least some of said first substantially unpumpable hydrocarbonaceous feedstock to produce a first mass of hydrocarbonaceous material vapor;

producing, through chemical reaction, a second mass of hydrocarbonaceous material vapor whose condensation point temperature is equal to or less than said first hydrocarbonaceous material constituent boiling point temperature;

generating a first liquid hydrocarbonaceous material bottoms having a bottoms viscosity that is greater than said first viscosity, and a bottoms density that is greater than said first density;

sweeping, with a sweep gas, at least a portion of said first and second mass of hydrocarbonaceous material vapors out of said reactor, at a pressure in said reactor that is from vacuum to slightly above atmospheric; and forming a hydrocarbonaceous material condensate from said at least said first and second mass of hydrocarbonaceous material vapors, wherein said hydrocarbonaceous material condensate has a second viscosity that is less than said first viscosity, and a second density that is less than said first density, wherein said hydrocarbonaceous material condensate has a condensate weight that is at least 30% said feedstock weight, wherein said first liquid hydrocarbonaceous material bottoms does not meet crude oil pipeline specification, wherein said second density and said second viscosity of said hydrocarbonaceous material condensate are each substantially independent of said reactor temperature and said residence time, and wherein said hydrocarbonaceous material condensate substantially matches crude oil pipeline specification, and wherein said first substantially unpumpable hydrocarbonaceous feedstock and said sweep gas are the only inputs into said reactor.

2. A hydrocarbonaceous material upgrading method as described in claim 1 further comprising the steps of:

heating said first liquid hydrocarbonaceous material bottoms to at least a second hydrocarbonaceous material constituent boiling point temperature that is higher than said first hydrocarbonaceous material constituent boiling point temperature;

vaporizing at least some of said first liquid hydrocarbonaceous material bottoms to produce a third mass of hydrocarbonaceous material vapor;

producing, through chemical reaction, a fourth mass of hydrocarbonaceous material vapor whose condensation point temperature is equal to or less than said second hydrocarbonaceous material constituent boiling temperature;

generating a second liquid hydrocarbonaceous material bottoms.

3. A hydrocarbonaceous material upgrading method as described in claim 2 wherein said step of forming a hydrocarbonaceous material condensate from at least said first and second mass of hydrocarbonaceous material vapors comprises the step of forming a hydrocarbonaceous material condensate from at least said first, second, third and fourth mass of hydrocarbonaceous material vapors.

4. A hydrocarbonaceous material upgrading method as described in claim 1 further comprising the steps of serially repeating the group of said steps of heating, vaporizing, producing and generating, where each subsequently performed group of said steps acts on a liquid bottoms generated by an immediately prior group of said steps.

5. A hydrocarbonaceous material upgrading method as described in claim 4 wherein said group of said steps is repeated until it costs more to conduct said repeated group of said steps than is the economic value of the yield of said repeated group of said steps.

6. A hydrocarbonaceous material upgrading method as described in claim 1 and further comprising the step of adding said hydrocarbonaceous material condensate to a second substantially unpumpable crude oil amount so as to produce a hydrocarbonaceous material whose viscosity substantially matches an oil pumping viscosity specification.

7. A hydrocarbonaceous material upgrading method as described in claim 1 wherein said first substantially unpumpable hydrocarbonaceous feedstock comprises extra heavy oil.

8. A hydrocarbonaceous material upgrading method as described in claim 1 wherein said first substantially unpumpable hydrocarbonaceous feedstock comprises bitumen.

9. A hydrocarbonaceous material upgrading method as described in claim 1 wherein said step of producing a second mass of hydrocarbonaceous material vapor comprises the step of holding said first substantially unpumpable hydrocarbonaceous feedstock for a residence time.

10. A hydrocarbonaceous material upgrading method as described in claim 1 further comprising the step of coking at least a portion of said first liquid hydrocarbonaceous material bottoms.

11. A hydrocarbonaceous material upgrading method as described in claim 10 wherein said step of coking said at least a portion of said first liquid hydrocarbonaceous material bottoms comprises the step of continuously coking said at least a portion of said first liquid hydrocarbonaceous material bottoms with a continuous coker.

12. A hydrocarbonaceous material upgrading method as described in claim 1 wherein said first substantially unpumpable hydrocarbonaceous feedstock comprises an unpumpable crude oil.

13. A hydrocarbonaceous material upgrading method as described in claim 1 wherein said slightly above atmospheric pressure is a pressure selected from the group consisting of: 1% above atmospheric pressure, 3% above atmospheric pressure, 5% above atmospheric pressure, 7% above atmospheric pressure, 10% above atmospheric pressure, 12% above atmospheric pressure, and 15% above atmospheric pressure.

14. A hydrocarbonaceous material upgrading method as described in claim 1 wherein said hydrocarbonaceous material condensate has a condensate weight that is at least 40% said feedstock weight.

15. A hydrocarbonaceous material upgrading method as described in claim 1 wherein said hydrocarbonaceous material condensate has a condensate weight that is at least 45% said feedstock weight.

16. A bitumen upgrading method comprising the steps of:

inputting bitumen into a reactor, said bitumen having a first viscosity, a first density, a first hydrogen to carbon ratio, and a bitumen weight;

heating, in said reactor, and at an operating pressure from vacuum to slightly above atmospheric pressure (psig), said bitumen to a reactor temperature and for a residence time from one to eight hours, wherein said reactor temperature is at least a first bitumen constituent boiling point temperature;

vaporizing, under said operating pressure, at least some of said first bitumen to produce a first mass of hydrocarbonaceous material vapor;

producing, through chemical reaction, a second mass of hydrocarbonaceous material vapor whose condensation point temperature is equal to or less than said bitumen constituent boiling point temperature;

generating a first liquid hydrocarbonaceous material bottoms having a bottoms viscosity that is greater than said first viscosity, and a bottoms density that is greater than said first density;

sweeping, with a sweep gas, at least a portion of said first and second mass of hydrocarbonaceous material vapors out of said reactor, at a pressure in said reactor that is from vacuum to slightly above atmospheric; and forming a hydrocarbonaceous material condensate from said at least said first and second mass of hydrocarbonaceous material vapors, wherein said hydrocarbonaceous material condensate has a second viscosity that is less than said first viscosity, and a second density that is less than said first density, wherein said hydrocarbonaceous material condensate has a condensate weight that is at least 30% said bitumen weight, wherein said first liquid hydrocarbonaceous material bottoms does not meet crude oil pipeline specification, wherein said second density and said second viscosity of said hydrocarbonaceous material condensate are each substantially independent of said reactor temperature and said residence time, and wherein said hydrocarbonaceous material condensate substantially matches crude oil pipeline specification, and wherein said bitumen and said sweep gas are the only inputs into said reactor.

17. A bitumen upgrading method as described in claim 16 wherein said bitumen has an API value of less than 19° API at pipeline conditions.

18. A bitumen upgrading method as described in claim 16 wherein said bitumen has a viscosity of greater than 350 cSt at pipeline conditions.

19. A bitumen upgrading method as described in claim 16 wherein said bitumen has an API value of less than 19° API and a viscosity of greater than 350 cSt at pipeline conditions.

20. A bitumen upgrading method as described in claim 16 further comprising the steps of:

heating said first liquid hydrocarbonaceous material bottoms to at least a second hydrocarbonaceous material constituent boiling point temperature that is higher than said first bitumen constituent boiling point temperature;

vaporizing at least some of said first liquid hydrocarbonaceous material bottoms to produce a third mass of hydrocarbonaceous material vapor;

producing, through chemical reaction, a fourth mass of hydrocarbonaceous material vapor whose condensation point temperature is equal to or less than said second hydrocarbonaceous material constituent boiling temperature;

generating a second liquid hydrocarbonaceous material bottoms.

21. A bitumen upgrading method as described in claim 16 wherein said step of forming a hydrocarbonaceous material condensate from at least said first and second mass of hydrocarbonaceous material vapors comprises the step of forming a hydrocarbonaceous material condensate from at least said first, second, third and fourth mass of hydrocarbonaceous material vapors.

22. A bitumen upgrading method as described in claim 16 further comprising the steps of serially repeating the group of said steps of heating, vaporizing, producing and generating, where each subsequently performed group of said steps acts on a liquid bottoms generated by an immediately prior group of said steps.

23. A bitumen upgrading method as described in claim 22 wherein said group of said steps is repeated until it costs more to conduct said repeated group of said steps than is the economic value of the yield of said repeated group of said steps.

24. A bitumen upgrading method as described in claim 16 and further comprising the step of adding said hydrocarbonaceous material condensate to a second substantially unpumpable crude oil amount so as to produce a hydrocarbonaceous material whose viscosity substantially matches an oil pumping viscosity specification.

25. A bitumen upgrading method as described in claim 16 wherein said step of producing a second mass of hydrocarbonaceous material vapor comprises the step of holding said bitumen for a residence time.

26. A bitumen upgrading method as described in claim 16 further comprising the step of coking at least a portion of said first liquid hydrocarbonaceous material bottoms.

27. A bitumen upgrading method as described in claim 26 wherein said step of coking said at least a portion of said first liquid hydrocarbonaceous material bottoms comprises the step of continuously coking said at least a portion of said first liquid hydrocarbonaceous material bottoms with a continuous coker.

28. A bitumen upgrading method as described in claim 16 wherein said slightly above atmospheric pressure is a pressure selected from the group consisting of: 1% above atmospheric pressure, 3% above atmospheric pressure, 5% above atmospheric pressure, 7% above atmospheric pressure, 10% above atmospheric pressure, 12% above atmospheric pressure, and 15% above atmospheric pressure.

29. A bitumen upgrading method as described in claim 16 wherein said hydrocarbonaceous material condensate has a condensate weight that is at least 40% said bitumen weight.

30. A bitumen upgrading method as described in claim 16 wherein said hydrocarbonaceous material condensate has a condensate weight that is at least 45% said bitumen weight.

31. A hydrocarbonaceous material upgrading method as described in claim 1 wherein said first substantially unpumpable hydrocarbonaceous feedstock has an API value of less than 19° API at pipeline conditions.

32. A hydrocarbonaceous material upgrading method as described in claim 1 wherein said first substantially unpumpable hydrocarbonaceous feedstock has a viscosity of greater than 350 cSt at pipeline conditions.

33. A hydrocarbonaceous material upgrading method as described in claim 1 wherein said first substantially unpumpable hydrocarbonaceous feedstock has an API value of less than 19° API and a viscosity of greater than 350 cSt at pipeline conditions.

* * * * *